US008365812B2

(12) United States Patent
Al-Hadhrami

(10) Patent No.: US 8,365,812 B2
(45) Date of Patent: Feb. 5, 2013

(54) SHELL AND TUBE HEAT EXCHANGER

(75) Inventor: Luai M. Al-Hadhrami, Dhahran (SA)

(73) Assignee: King Fahd University of Petroleum and Minerals, Dhahran (SA)

( * ) Notice: Subject to any disclaimer, the term of this patent is extended or adjusted under 35 U.S.C. 154(b) by 1345 days.

(21) Appl. No.: 11/819,515

(22) Filed: Jun. 27, 2007

(65) Prior Publication Data

US 2009/0000775 A1 Jan. 1, 2009

(51) Int. Cl.
*F28F 19/00* (2006.01)
*F28D 7/16* (2006.01)

(52) U.S. Cl. ..... 165/159; 165/134.1

(58) Field of Classification Search ..... 165/159, 165/134.1

See application file for complete search history.

(56) References Cited

U.S. PATENT DOCUMENTS

| | | | | | |
|---|---|---|---|---|---|
| 1,457,941 | A | * | 6/1923 | Shevlin | 165/159 |
| 1,662,143 | A | * | 3/1928 | Braun | 165/159 |
| 2,311,190 | A | * | 2/1943 | Shaw | 165/159 |
| 2,830,797 | A | * | 4/1958 | Garland | 165/161 |
| 3,351,131 | A | * | 11/1967 | Berthold | 165/159 |
| 3,646,963 | A | | 3/1972 | Klee | |
| 3,760,844 | A | | 9/1973 | Olson et al. | |
| 3,765,441 | A | | 10/1973 | Chang | |
| 4,249,596 | A | | 2/1981 | Tutak et al. | |
| 4,550,775 | A | * | 11/1985 | Edwards et al. | 165/111 |
| 4,576,222 | A | * | 3/1986 | Granata et al. | 165/134.1 |
| 4,637,457 | A | | 1/1987 | Wepfer | |
| 4,643,249 | A | | 2/1987 | Grawey | |
| 4,736,713 | A | * | 4/1988 | Roarty | 165/160 |
| 4,815,533 | A | | 3/1989 | Harada et al. | |
| 5,117,903 | A | | 6/1992 | Oshiyama et al. | |
| 5,163,508 | A | | 11/1992 | Hamos | |
| 5,232,153 | A | | 8/1993 | Mohring et al. | |
| 5,353,864 | A | | 10/1994 | Greenland et al. | |
| 5,415,223 | A | | 5/1995 | Reavis et al. | |
| 5,419,391 | A | * | 5/1995 | Chan et al. | 165/159 |
| 5,934,367 | A | | 8/1999 | Shimmura et al. | |
| 6,167,713 | B1 | * | 1/2001 | Hartfield et al. | 165/160 |
| 6,305,331 | B1 | | 10/2001 | Fullemann et al. | |
| 6,340,051 | B1 | | 1/2002 | Bloksma | |
| 6,382,313 | B2 | * | 5/2002 | Mitsumoto et al. | 165/159 |
| 6,513,583 | B1 | | 2/2003 | Hughes | |
| 6,705,392 | B2 | | 3/2004 | Gotou et al. | |
| 6,892,805 | B1 | | 5/2005 | Valensa | |
| 7,117,934 | B2 | | 10/2006 | Lomax, Jr. et al. | |
| 2003/0173062 | A1 | | 9/2003 | Lomax et al. | |
| 2005/0167089 | A1 | | 8/2005 | Ozeki et al. | |

FOREIGN PATENT DOCUMENTS

| | | | | |
|---|---|---|---|---|
| JP | 58006391 | A | * | 1/1983 |
| JP | 63207997 | A | * | 8/1988 |

* cited by examiner

*Primary Examiner* — Leonard R Leo
(74) *Attorney, Agent, or Firm* — Richard C. Litman

(57) ABSTRACT

The shell and tube heat exchanger includes a shell having a fluid inlet and a fluid outlet, and a plurality of tubes disposed inside the shell, the tubes having a fluid inlet and a fluid outlet. An impingement baffle having a plurality of perforations is disposed in the shell between the shell fluid inlet and the tubes. The impingement baffle is configured to guide a heat exchanger fluid from the shell fluid inlet to distribute the heat exchanger fluid uniformly around the tubes. The perforations prevent recirculation and stagnation of fluid flow behind the baffle, thereby preventing fouling and corrosion with subsequent thinning of the tube walls.

6 Claims, 5 Drawing Sheets

SHELL AND TUBE HEAT EXCHANGER

BACKGROUND OF THE INVENTION

1. Field of the Invention

The present invention relates to a heat exchanger, and more particularly to a shell and tube heat exchanger having improved resistance to fouling of the exchanger fluid and corrosion of the tubes.

2. Description of the Related Art

A shell and tube heat exchanger is a class of heat exchanger that is most commonly found in oil refineries and other large chemical processing plants. This type of heat exchanger comprises a shell, i.e., a large vessel, and a bundle of tubes inside the shell. The shell and tube heat exchanger is designed to allow two fluids of different starting temperatures to flow through it. A first fluid flows through the tubes (the tube side), while a second fluid flows in the shell (the shell side) but outside the tubes. Heat is transferred between the two fluids through the tube walls, either from tube side to shell side or vice versa. The fluids may be either liquids or gases on either the shell or the tube side. In order to transfer heat efficiently, a large heat transfer area is generally used, requiring many tubes, which are usually disposed horizontally inside the tank-like shell structure.

To achieve effective heat transfer between the fluids in the heat exchanger, it is a must to distribute shell side fluid to flow uniformly over the tube banks. Various methods are employed to distribute the shell side fluid uniformly. One such commonly used method employs a baffle plate placed in between the inlet and the tube bundle. This method is effective enough in distributing the shell side fluid more or less uniformly around the tube bundles, but seems to be accompanied by fouling and corrosion on the tubes in the region next to inlet baffle plate.

Due to fouling and corrosion, these heat exchangers experience severe external wall thinning of the tubes beyond allowable limits. For continuous operation of such heat exchangers, the tubes are replaced on a regular basis, causing the plant to shut down. Several attempts have been made to eliminate the problem by upgrading the tube metallurgy, but the problem has persisted.

During heat exchanger operations, fluid enters the shell side with high velocity. Kinetic energy of the fluid is reduced sharply upstream and downstream of the impingement plates due to sudden expansion and constriction of flow in the area of the inlet nozzles. It has been empirically determined that recirculation zones proximate to and behind the impingement plates cause the fluid to become stagnant. Moreover, the recirculation zones encourage impurities and particles carried by the fluid to foul, (deposit), and create active corrosion that causes a thinning process in the tube wall to the extent that the heat exchanger must be replaced when the walls are too thin for safe operations.

Thus, a shell and tube heat exchanger solving the aforementioned problems is desired.

SUMMARY OF THE INVENTION

The shell and tube heat exchanger includes a shell having a fluid inlet and a fluid outlet, and a plurality of tubes disposed inside the shell, the tubes having a fluid inlet and a fluid outlet. An impingement baffle having a plurality of perforations is disposed in the shell between the shell fluid inlet and the tubes. The impingement baffle is configured to guide a heat exchanger fluid from the shell fluid inlet to distribute the heat exchanger fluid uniformly around the tubes. The perforations prevent recirculation and stagnation of fluid flow behind the baffle, thereby preventing fouling and corrosion with subsequent thinning of the tube walls.

The perforations are disposed on a symmetric half of the baffle, with transverse pitch (Tp), longitudinal pitch (Lp), and a dimension of each perforation specified according to the heat exchanger size. Perforation axes are aligned with respect to the tube axes so that the fluid flows around the tubes to minimize the effect of recirculation zones. Use of the perforated inlet baffle minimizes fouling of impurities and particles behind the baffle plate.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
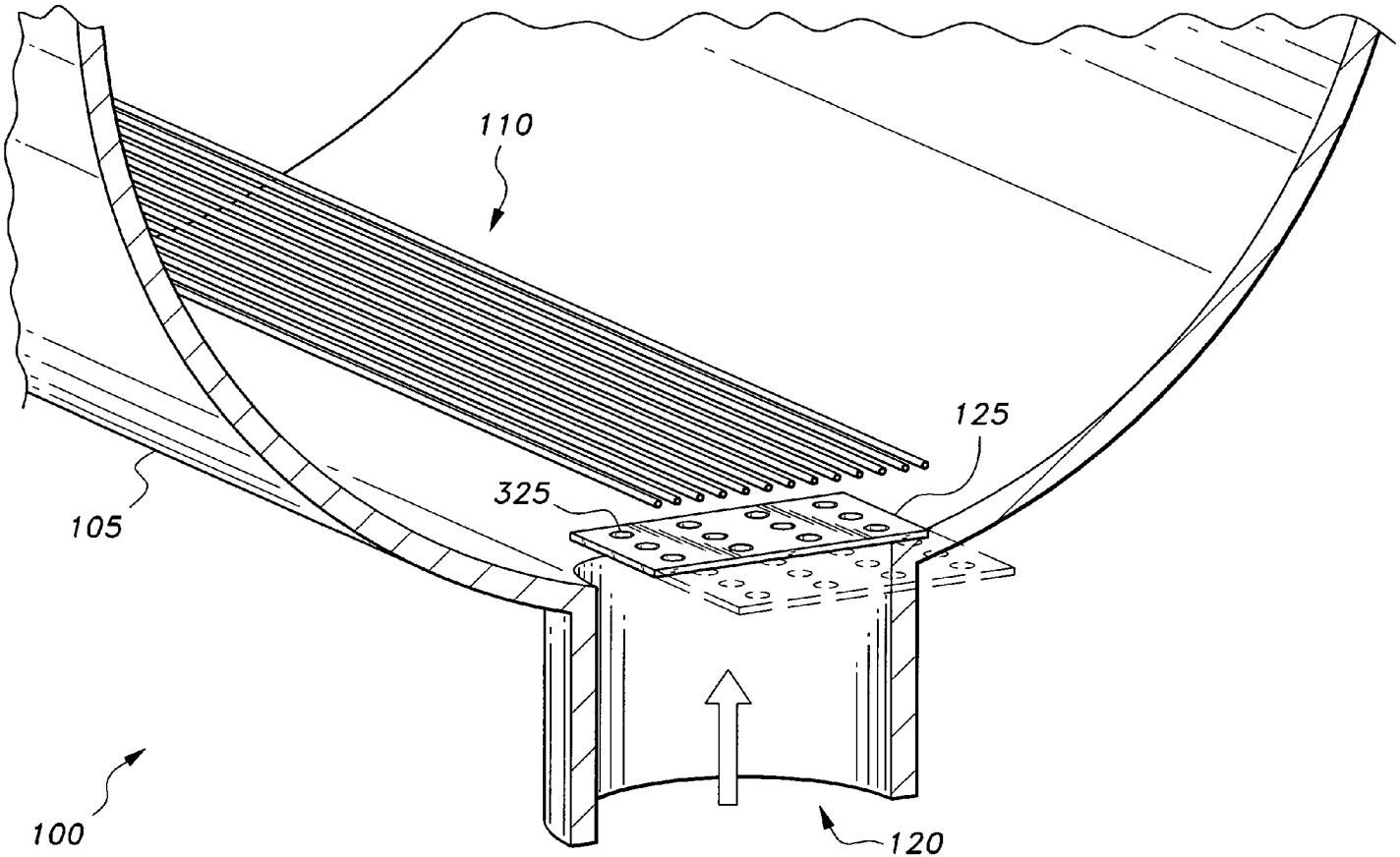
FIG. 1 is a partial perspective view in section of a shell and tube heat exchanger according to the present invention, showing the impingement baffle plate disposed behind the shell fluid inlet.
Figure 2:
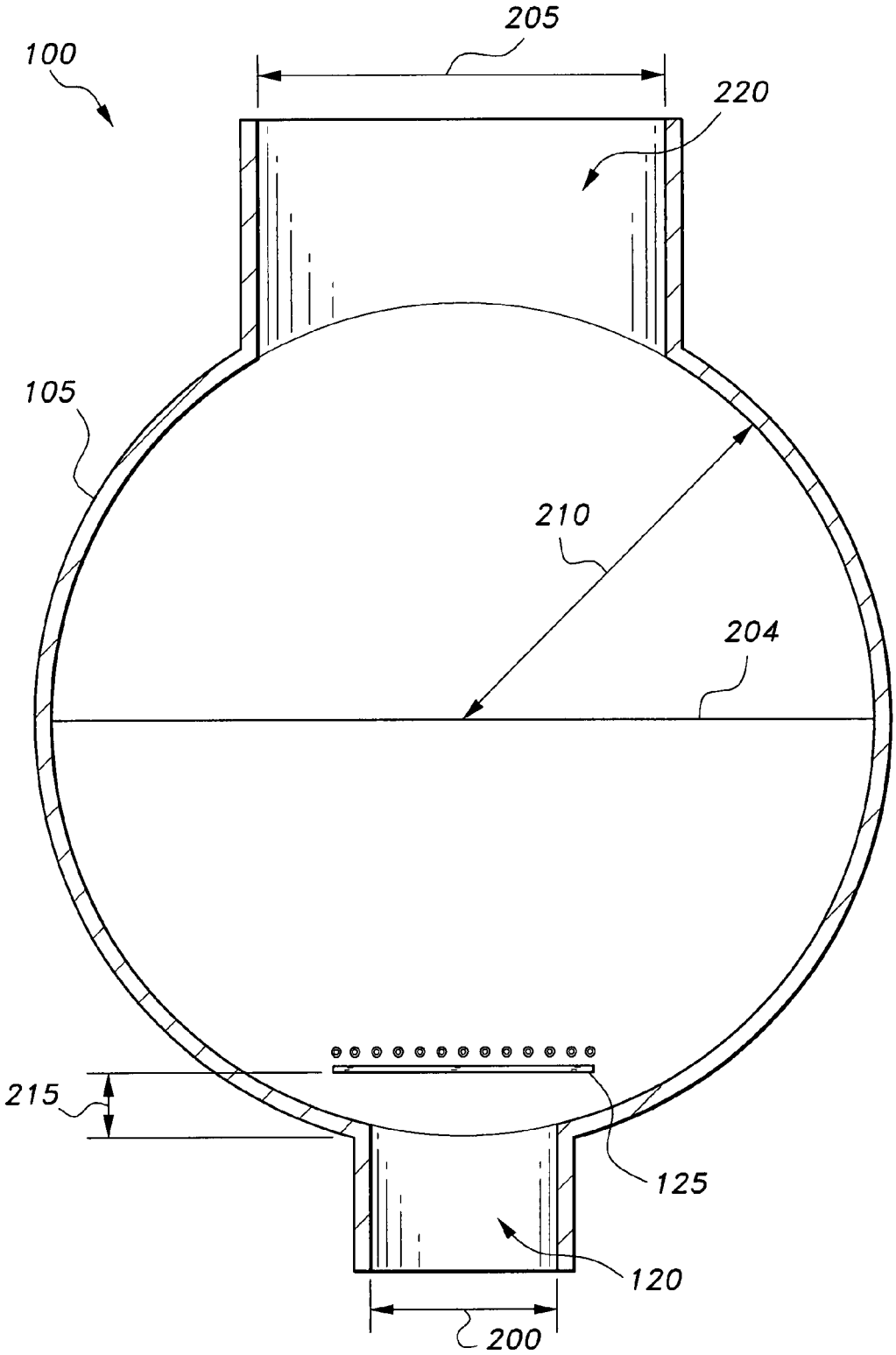
FIG. 2 is a transverse elevational section view of the shell and tube heat exchanger according to the present invention.
Figure 3:
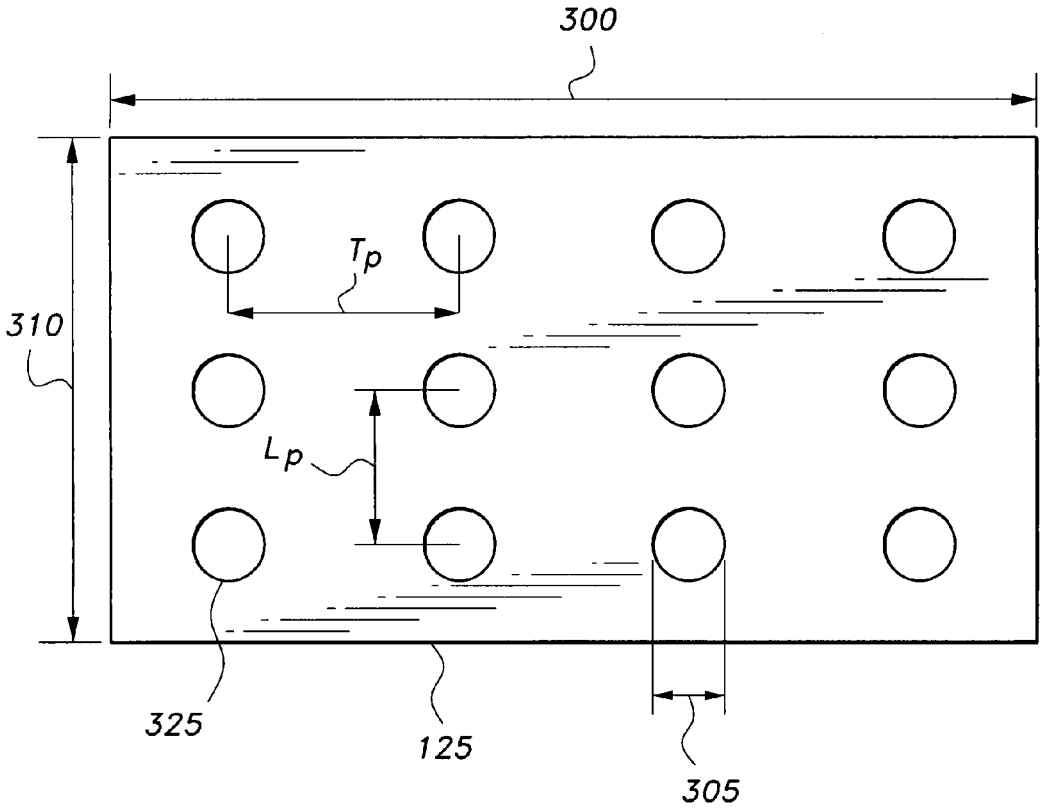
FIG. 3 is a top view of an impingement baffle plate for the shell and tube heat exchanger according to the present invention.

As shown in FIGS. 1 and 2, the present invention is a shell and tube heat exchanger 100 that includes a shell housing 105 having at least one shell inlet port 120 for flow of a heat exchanger fluid through the shell 105. An exemplary inlet port 120 can have a diameter 200 of approximately 200 mm. At least one impingement baffle plate 125 having a plurality of perforations 325 defined therein is disposed in the shell 105 proximate to the shell inlet port 120 normal to the direction of fluid flow through the inlet, e.g., a distance 215 of approximately 117 mm from the mouth of the inlet 120. As shown in FIG. 3, the perforations 325 are disposed on a symmetric half of the baffle 125, e.g., with transverse pitch (Tp) as shown being approximately 50 mm, longitudinal pitch (Lp) as shown being approximately 32.5 mm, each perforation having a diameter 305 of approximately 25 mm. It will be understood that the baffle plate dimensions may be scaled up or down, depending on the heat exchanger size, the foregoing dimensions being representative dimensions to illustrate relative size.

As shown in FIG. 3, the shell impingement baffle plate 125 is preferably rectangular in shape, and has a lateral dimension 300 of approximately 374.65 mm and a longitudinal dimension 310 of approximately 142 mm. As shown in FIG. 2, a divider baffle 204 is disposed at a predetermined longitudinal distance, e.g., 451.5 mm, above the impingement baffle 125 (radial distance 210 minus impingement baffle plate distance 215). The divider baffle plate radial distance 210 may be 568.5 mm, or otherwise scaled to a distance in proportion to the size of the heat exchanger.

Figure 4:
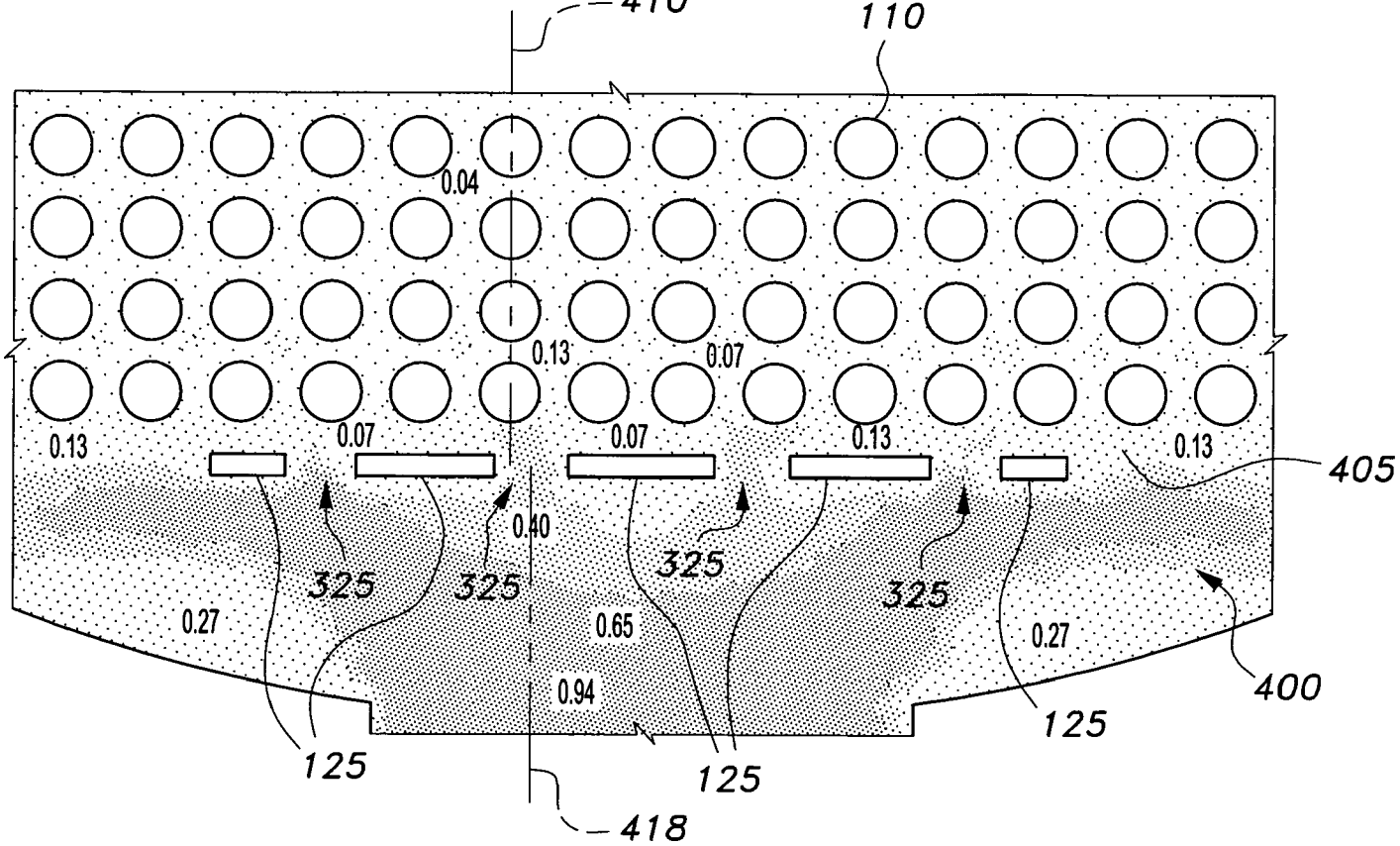
FIG. 4 is a diagram showing velocity distribution of fluid flow around the tubes and around and through the impingement baffle plate of the shell and tube heat exchanger of the present invention.

A shell outlet 220 may be disposed opposite the shell inlet 120, the outlet 220 having an outlet diameter 205 of approximately 400 mm. As shown in FIGS. 1, 2, and 4, tubes 110 carrying a fluid to be heated or cooled are disposed between the impingement baffle plate 125 and the divider baffle 204. The baffle 125 has sufficient surface area that heat exchanger fluid entering through inlet 120 does not flow directly to outlet 220, but is spread out to circulate around all of the tubes 110. Perforations 325 assure that no dead zone or stagnant area develops between baffle plate 125 and tubes 110. An axis 418 or axes parallel to the direction of fluid flow and extending through the center of the perforations 325 is aligned with (parallel to) an axis 410 or axes through the center line of a column of tubes 110 so that tube fouling and corrosion in a zone 405 between the baffle plate 125 and tubes 110 caused by stagnation of fluid flow is minimized.

Figure 5:
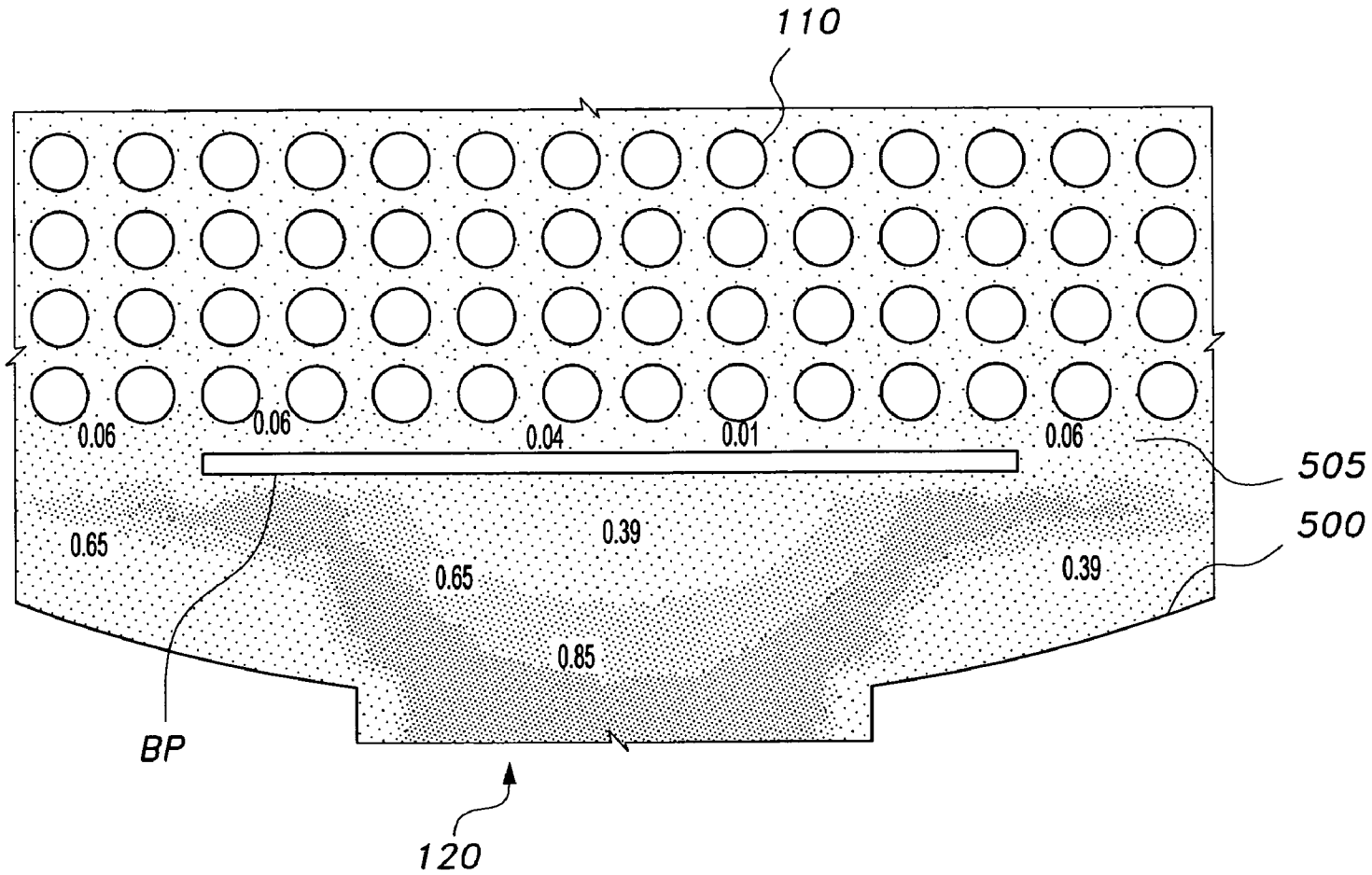
Fig. 5 (PRIOR ART)
FIG. 5 is a diagram showing velocity distribution of fluid flow around the tubes and around the inlet baffle plate of a shell and tube heat exchanger of the prior art.

As shown in FIG. 5, baffle plates BP of prior art shell and tube heat exchanger systems are not perforated. The fractional numbers in FIGS. 4 and 5 represent fluid flow velocities in various regions, such as the regions 400 and 500 between the shell inlet baffle plate 125 and BP, respectively, and the shell inlet 120. It should be readily understood from the 0.06, 0.04, and 0.01 values shown that the velocity distribution in the region 505 between the tubes 110 and the inlet baffle plate BP is relatively stagnant due to a recirculation zone. This recirculation zone causes deposition of impurities and heavy particles, resulting in severe external corrosion of the tubes 110 located on top of baffle plate BP.

In contrast, as shown in FIG. 4, it can be seen easily from the distribution numbers displayed in regions 400 and 405 that the velocity over the perforated baffle plate 125 is not stagnant. Thus, suppression of the recirculation zone is achieved so that impurities and heavy particles have no chance to deposit.

It is to be understood that the present invention is not limited to the embodiment described above, but encompasses any and all embodiments within the scope of the following claims.

I claim:

1. A shell and tube heat exchanger, comprising:

a shell having an inlet port on the lower surface of the shell and an outlet port on the opposed upper shell surface for flow of a heat exchanger fluid through the shell from bottom-to-top, wherein the outlet port is larger than the diameter of the inlet port;

a plurality of tubes disposed within the shell adjacent the inlet port, the tubes being adapted for flow of a fluid to be heated or cooled therethrough, wherein the plurality of tubes are axially aligned in a plurality of rows; and a perforated impingement baffle plate disposed between the shell inlet port and the tubes normal to a direction of fluid flow from the inlet port into the shell and defining the first baffle plate encountered by the fluid flow from the inlet port, said perforated impingement baffle plate having a substantially rectangular contour and being elongated along a transverse axis thereof, wherein each of the perforations include a perforation axis that is parallel to the axes of the axially aligned tubes, the perforations each being identical in diameter, the baffle plate having sufficient surface area to divert heat exchanger fluid flow from the inlet to provide uniform distribution around the tubes and wherein the perforations permit sufficient heat exchanger fluid flow between the baffle plate and the tubes to prevent stagnation, fouling, and corrosion of the tubes, the plurality of perforations defining a continuous and regular rectangular grid having uniform transverse spacing and uniform longitudinal spacing, wherein a ratio of transverse pitch between transversely adjacent ones of said plurality of perforations and longitudinal pitch between longitudinally adjacent ones of said plurality of perforations is approximately 1.54, the transverse pitch between transversely adjacent ones of said plurality of perforations being approximately 50 mm, and the longitudinal pitch between longitudinally adjacent ones of said plurality of perforations being approximately 32.5 mm.

2. The shell and tube heat exchanger according to claim 1, further comprising a divider baffle disposed within the shell between the tubes and the outlet port.

3. The shell and tube heat exchanger according to claim 1, wherein the tubes extend in a direction normal to the direction of fluid flow from the inlet port into the shell.

4. The shell and tube heat exchanger according to claim 1, wherein each said perforation has a diameter of approximately 25 mm.

5. A shell and tube heat exchanger, comprising:

a shell having an inlet port on the lower surface of the shell and an outlet port on the opposed upper shell surface for flow of a heat exchanger fluid through the shell from bottom-to-top, wherein the outlet port is larger than the diameter of the inlet port;

a plurality of tubes disposed within the shell adjacent the inlet port, the tubes being adapted for flow of a fluid to be heated or cooled therethrough, wherein the plurality of tubes are axially aligned in a plurality of rows, wherein the plurality of tubes extend in a direction normal to the direction of fluid flow from the inlet port into the shell;

a perforated impingement baffle plate disposed between the shell inlet port and the tubes normal to a direction of fluid flow from the inlet port into the shell and defining the first baffle plate encountered by the fluid flow from the inlet port, said perforated impingement baffle plate having a substantially rectangular contour and being elongated along a transverse axis thereof, wherein each of the perforations include a perforation axis that is parallel to the axes of the axially aligned tubes, the perforations being identical in diameter, the baffle plate having sufficient surface area to divert heat exchanger fluid flow from the inlet to provide uniform distribution around the tubes and wherein the perforations permit sufficient heat exchanger fluid flow between the baffle plate and the tubes to prevent stagnation, fouling, and corrosion of the tubes, the plurality of perforations defining a continuous and regular rectangular grid having uniform transverse spacing and uniform longitudinal spacing, a ratio of transverse pitch between transversely adjacent ones of said plurality of perforations and longitudinal pitch between longitudinally adjacent ones of said plurality of perforations is approximately 1.54, the transverse pitch between transversely adjacent ones of said plurality of perforations being approximately 50 mm, and the longitudinal pitch between longitudinally adjacent ones of said plurality of perforations being approximately 32.5 mm; and a divider baffle disposed within the shell between the tubes and the outlet port.

6. The shell and tube heat exchanger according to claim 5, wherein each said perforation has a diameter of approximately 25 mm.

* * * * *